US010526101B2

(12) United States Patent
Voss et al.

(10) Patent No.: US 10,526,101 B2
(45) Date of Patent: Jan. 7, 2020

(54) DETECTION DEVICE FOR THE USE IN A BAG FILLING PLANT

(71) Applicant: Windmoeller & Hoelscher KG, Lengerich (DE)

(72) Inventors: Hans-Ludwig Voss, Tecklenburg (DE); Oliver Huil, Hoerstel (DE); Ralf Udally, Bonn (DE)

(73) Assignee: WINDMOELLER & HOELSCHER KG, Lengerich (DE)

( * ) Notice: Subject to any disclaimer, the term of this patent is extended or adjusted under 35 U.S.C. 154(b) by 656 days.

(21) Appl. No.: 14/289,941

(22) Filed: May 29, 2014

(65) Prior Publication Data

US 2014/0357462 A1 Dec. 4, 2014

(30) Foreign Application Priority Data

May 29, 2013 (DE) ..... 10 2013 105 545

(51) Int. Cl.

| | |
|---|---|
| ***B65B 57/02*** | (2006.01) |
| ***B65B 5/06*** | (2006.01) |
| ***B65B 41/16*** | (2006.01) |
| ***B65B 43/46*** | (2006.01) |
| ***B65B 43/52*** | (2006.01) |
| ***B65B 9/13*** | (2006.01) |
| ***B65B 57/04*** | (2006.01) |
| ***B65B 41/18*** | (2006.01) |
| ***B65B 59/02*** | (2006.01) |

(52) U.S. Cl.

CPC ..... *B65B 57/02* (2013.01); *B65B 5/06* (2013.01); *B65B 9/13* (2013.01); *B65B 41/16* (2013.01); *B65B 41/18* (2013.01); *B65B 43/465* (2013.01); *B65B 43/52* (2013.01); *B65B 57/04* (2013.01); *B65B 59/02* (2013.01)

(58) Field of Classification Search

CPC ..... B65B 41/16; B65B 41/18; B65B 43/465; B65B 43/52; B65B 57/04; B65B 59/02; B65B 5/06; B65B 57/02; B65B 9/13

See application file for complete search history.

(56) References Cited

U.S. PATENT DOCUMENTS 4,141,392 A 2/1979 Moltrasio
4,378,109 A * 3/1983 Takahashi ..... B65H 7/12 209/603

(Continued)

FOREIGN PATENT DOCUMENTS

AT 413378 2/2006
DE 2719459 11/1977

(Continued)

*Primary Examiner* — Chelsea E Stinson
*Assistant Examiner* — Thomas M Wittenschlaeger
(74) *Attorney, Agent, or Firm* — Jacobson Holman, PLLC.

(57) ABSTRACT

A bag filling plant includes a detection device for detecting a thickened section of a film web associated with an end of a first film and a start of a second film. The detection device includes a first film roll and a second film roll, which contact the film web on side areas aligned opposite each other and which form a conveyer gap for the film web, with the first film roll being movably supported relative to the second film roll in order to alter the conveyer gap. The detection device includes a sensor device that detects a motion of the first conveyer roll.

6 Claims, 4 Drawing Sheets

(56) References Cited

U.S. PATENT DOCUMENTS 4,467,589 A * 8/1984 van Maanen ..... B65B 41/18 156/164
4,491,929 A * 1/1985 Ikoma ..... B65H 7/12 226/177
4,532,166 A 7/1985 Thomsen et al.
4,550,252 A * 10/1985 Tee ..... B65H 7/12 250/223 R
4,826,149 A * 5/1989 Tucker ..... B65H 7/12 271/263
4,976,089 A * 12/1990 Reichelt ..... B65B 57/04 53/389.3
5,203,555 A * 4/1993 Cannaverde ..... B65H 7/12 271/263
5,388,387 A * 2/1995 McElvy ..... B65B 9/207 156/502
6,672,587 B1 * 1/2004 Mohringer ..... B65H 7/12 271/259
6,734,417 B2 * 5/2004 Vejtasa ..... B65H 7/12 209/604
7,559,184 B2 7/2009 Grzonka et al.
2004/0112527 A1 * 6/2004 Keene ..... B65H 19/1852 156/304.1
2004/0206056 A1 * 10/2004 Hiramoto ..... B65B 43/04 53/562
2010/0102505 A1 * 4/2010 Ikeuchi ..... B65H 1/14 271/262
2011/0210505 A1 * 9/2011 Tomii ..... B65H 7/02 271/265.04
2011/0210506 A1 * 9/2011 Yamazaki ..... B65H 7/02 271/265.04
2012/0137533 A1 * 6/2012 Muranaka ..... B65H 7/02 33/833
2012/0228818 A1 * 9/2012 Seki ..... B65H 3/44 271/109
2013/0036710 A1 * 2/2013 Knoke ..... B65B 1/02 53/412
2013/0051824 A1 * 2/2013 Bobo ..... G03G 15/2032 399/45

FOREIGN PATENT DOCUMENTS

| | | |
|---|---|---|
| DE | 3823201 | 12/1988 |
| DE | 102004036795 | 3/2006 |
| DE | 102010028394 | 11/2011 |
| WO | WO 02/102665 | 12/2002 |
| WO | WO 2006/013171 | 2/2006 |

* cited by examiner

DETECTION DEVICE FOR THE USE IN A BAG FILLING PLANT

BACKGROUND OF THE INVENTION

1. Field of Invention

The present invention relates to a detection device for the use with a bag filling plant to detect an overlapping section of a film web, a bag filling plant comprising such a detection device, as well as a method for detecting an overlapping section of a film web.

2. Description of the Prior Art

In general it is known to use bag filling plants, in order to package bulk goods into film bags. For this purpose, such a hag filling plant usually comprises a supply roll with a film web. A film web is roiled off this supply roll and reaches the interior of the machine. A plurality of processing stations is provided inside this bag filling plant. On the one hand, they represent sealing stations for sealing bottom seams and head seams as well as cutting devices for cutting to length individual bag sections.

A filling station is also provided for filling in bulk goods. When the supply on the supply rolls approaches its end, a so-called change of roll must occur. This means, that at the end of the film in use which approaches the end of the supply roll, it must be replaced by a subsequent film, thus a new supply roll, which is full. For this purpose, the end of the film in use must be adhered and/or welded to the start of the subsequent film in order to provide an essentially continuous film web for the hag filling plant. In other words, the subsequent film is entrained, by the adhesion to the film in use, together with the film in use into the bag filling plant and moved thereby through it.

It is disadvantageous in bag filling plants of prior art that here manual monitoring must occur of this adhesion section. The adhesion of the film in use with the subsequent film leads to an overlapping area, which shows a considerably greater thickness than the individual film web. Accordingly, these overlapping sections are not suitable for the filling process in the hag filling plant. Rather, it must be ensured that the film webs are only provided for the filling process in the hag filling plant with their intact sections, which are free from overlapping sections. In other words, the section, which includes the overlapping section, represents reject parts of the film web. In bag filling plants of prior art, a visual monitoring occurs by the operator after the adhesion of the end of the film in use to the start of the subsequent film web. The machine is therefore slowly run up again so that the operator of the bag filling plant can visually follow the overlapping section (passing) through the machine. When the overlapping section reaches the cutting station inside the bag filling plant it is manually ensured that these sections are ejected and/or manually removed. The visual monitoring requires high expenses. In particular, during the visual monitoring a relatively slow conveying velocity must be adjusted in the bag filling plant. The manual removal also leads to time delays, so that for the solutions of prior art a long period of time must be reserved for exchanging the rolls. Additionally, it is not ensured here that actually each overlapping section is really removed as discards. The purely manual operation leads to respective susceptibility to errors, when a faulty operation is given by the operating personnel.

SUMMARY OF THE INVENTION

The objective of the present invention is to at least partially correct the above-described disadvantages. In particular, the objective of the present invention is to allow accelerating and/or ensuring the roll exchange of the roll in use of a bag filling plant in a cost-effective and simple fashion.

The above-stated objective is attained in a detection device, a bag filling plant, and a method having the features described herein. Additional features and details of the invention are ala discernible from the written description, and the drawings. Here, features and details described in the context with the detection device according to the invention also apply of course to the method according to the invention described in the context with the bag filling plant according to the invention and vice versa, so that with regard to the disclosure, reference is always made and/or can be made alternating to the individual aspects of the invention.

The detection device according to the invention is embodied for the use in a hag filling plant for detecting a thickened area, particularly an overlapping section, of a film web between an end of the film web of a film in use and a start of the film web of a subsequent film. For this purpose, the detection device according to the invention comprises a first film roll and a second film roll, which contact the film web on side areas aligned opposite. The film rolls are preferably supported rotationally. Here, the first film roll is supported mobile in reference to the second film roll, in order to allow changing the conveyer gap between the two film rolls. Further, a sensor device is arranged for detecting the motion of the first conveyer roll.

According to the invention now a detection device is provided, which is capable to automatically detect the overlapping section. This overlapping section develops, as already explained, during the adhesion and/or welding of the end of the film web of the film in use to the start of the film web of the subsequent film. Contrary to the previously necessary visual tracking of this overlapping section traveling through the bag filling plant, when using the detection device according to the invention, the bag filling plant can essentially continue operating at full velocity after the exchange of the roll.

The detection device is now capable to detect the overlapping section in an automatic fashion and this way unambiguously defines and/or indicates the entry and/or the position of the overlapping section. Subsequently, also in an automated or manual fashion, the removal can occur of the overlapping section and/or respective bag sections, which contain such an overlapping section.

According to the invention the detection of the overlapping section occurs by the correlation of the two film rolls via the sensor device. Here, the two film rolls are arranged contacting the film web. Preferably the film roll is supported rotationally, so that during the conveyance of the film web through the conveyer gap an opposite rotation of the film rolls occurs. The contacting at the side areas of the film web remains essentially maintained over the entire conveyance of the film web. When now the thickness of the film web varies, for example because an overlapping section reaches the conveyer gap, the conveyer gap showing the previous size is no longer sufficient to move the thicker film web through it. However, in order to ensure continued conveyance of the film web the first film roll is supported mobile in reference to the second film roll. In other words, now the thicker film web, for example due to the overlapping section, can enforce the larger conveyer gap by moving the first film roll in reference to the second film roll and thus enlarging the conveyer gap. When the overlapped section has completely passed through the conveyer gap the opposite motion can occur to reduce the conveyer gap, thus the first film roll moves back towards the second film roll.

As explained above, the first film roll essentially moves exclusively based on the thickness conditions of the film web and based on the width of the conveyer gap altered thereby. Any active motion of the film roll is not required here. Accordingly, a particularly cost-effective and simple embodiment of this mobility of the first film roll can be provided, here.

As explained above, the motion is generated by the overlapping section of the film web and its greater thickness. Now, when according to the invention a sensor device is provided, which can detect this motion, here a conclusion can be drawn to a change in the width of the conveyer gap.

A changed width of the conveyer gap mandatorily results from an altered thickness of the film web, for example when an overlapping section has been reached. Accordingly the sensor device is capable to indirectly detect the passing of the overlapping section between the two conveyer rolls. This information can be forwarded as a parameter or as a data set to a control device, in order to allow ensuring the ejection of this bag section of the film web. Here, the detection device may be a part of a drive device, in order to allow ensuring for example the advance of the film web. The sensor devices may be embodied arbitrary in the sense of the present invention. It is decisive that the motion of the first film roll is detected. Here, particularly the direction of motion must be detectable, which is connected to an enlargement of the conveyer gap. However, it may also be advantageous for the sensor device to detect a motion of the film roll in both directions, so that actively the position of the first film roll can be determined in reference to the second film roll. In general, end position switches as well as motion detectors are possible as sensor devices.

It may be advantageous for the sensor device to comprise adjustment options, which allow setting a threshold in order to allow adjusting the detection quality. This way it is ensured that minor variations in thickness of the film web are not sufficient to trigger the detection steps for removing a bag section. Rather, here it is distinguished between simple variations in thickness of a film web within a film in use and a distinct difference in thickness when reaching an overlapping section. Here, the overlapping section shows particularly such thicknesses which measure a thickness of the film web twofold to fourfold the normal one.

The contacting of the film rolls towards the side areas of the film web occurs preferably even by a partial enwrapping in order to allow providing sufficient friction contact. Here, the motion of the first film roll may be understood as a purely translational motion but also as a pivotal one. It is decisive here that the ability of the film roll to rotate is influenced only slightly or not at all by the mobility in reference to the second film roll.

Here, the sensor device is fastened in or at the second film roll and/or at its bearing. Separate arrangements, for example at a frame or a housing of the bag filling plant, are also possible in order to provide the quality according to the invention.

In addition to increased security during the execution of the roll exchange, the detection device according to the invention also allows higher speeds of the bag filling plant during said roll exchange. Additionally, a particularly simple and cost-effective design is possible, because in particular a coupling of the detection device is possible to the advance device.

It may be advantageous in a detection device according to the invention that at least one of the two film rolls comprises a drive device for a rotary drive of this film roll and thus an active conveyance of the film web. In order to allow ensuring a motion of the film web by the bag filling plant the transportation forces must be transferred to the film. Usually, so-called advance drives are provided for this purpose, which via film rolls and appropriate friction contact transfer the force for the transportation of the film web to said web, in the event that in the embodiment according to the invention this advance drive is embodied with a detection device according to the invention combined in one functional unit this leads to considerably reduced complexity and lower costs. Additionally, the required structural space of the detection device is reduced to a minimum, because preferably construction space already provided can be used for the advance drive. Here, the drive device may be embodied for a continuous, but also for a clocked advance of the film web.

Another advantage can be achieved when in a detection device according to the invention the first film roll comprises a spring device, which impinges the first film roll with a force in the direction of reducing the conveyer gap.

This spring device may represent for example a coil spring or a rotary spring. This spring three serves for resetting after an overlapping section has been detected. Simultaneously, by this spring device sufficient compression can be ensured in the direction towards the conveyer gap, thus upon the film web. It is ensured that the detection device, after an overlapping section has passed, returns to a detection position, which is embodied to detect a subsequent overlapping section. Preferably this spring device is combined with a drive device, as explained in the previous paragraph.

Another advantage is given when in a detection device according to the invention the first film roll comprises a stop device with at least one stop for limiting the enlargement and/or reduction of the conveyer gap. This stop device with one or more stops therefore leads to prevent any arbitrary variations of the conveyer gap. In particular it is prevented that, even in case of a complete removal of the film web from the conveyer gap, the two conveyer rolls come into contact. In other words, a minimum conveyer gap is adjusted, in order to facilitate the initial feeding of the film web, for example. This way, additionally an increased spring force can be provided according to the previous paragraph, because any impression into the film web by such a stop against a reduction of the conveyer gap cannot lead to a full impact upon the film web. Preferably, stops are provided in both directions, in order to also allow setting an upper limit for the variation of the conveyer gap.

A detection device according to the invention can be further developed such that the sensor device comprises at least one of the following sensor means:

inductive sensor means,
capacitive sensor means,
pressure switch,
photosensor,
proximity sensor,
force sensor,
ultrasound sensor, The above listing represents no complete list. Of course, two or more sensor means of one type or several different types may be combined with each other for a sensor device. In particular, position sensors and/or end position sensors are used. However, here sensors are also possible which can generally detect a motion through a monitoring area. Additionally, rotary sensors may be provided, which at a pivotal support can be arranged directly in the pivotal bearing device of the first film roll. This way, the security is also provided with particularly precise detection tolerances, particularly in case of minor motions of the first film roller.

Another advantage is given when in a detection device according to the invention the first film roll comprises a pivotal support for the pivotal bearing device at the bag filling plant. This support occurs preferably at the frame and/or the housing of the hag filling plant. A pivotal support is a particularly cost-effective embodiment of an articulate arrangement of the first film roll. This also relates to a type of bearing, which is particularly tolerant to errors, because any jamming and/or canting of the motion of the first film roll can be almost excluded. For example, rotary sensors and/or rotary springs may also be used, which can be arranged directly at the bearing point of the pivotal bearing device.

Another objective of the present invention is a bag filling plant for the production and filling of bags with bulk goods, comprising a detection device according to the invention for detecting an overlapping section of the film web between an end of the film web of a film in use and a start of a film web of a subsequent film web. By the use of a detection device according to the invention the bag filling plant according to the invention provides the same advantages as those explained in greater detail with reference to the detection device according to the invention.

The bag filling plant according to the invention comprises particularly a plurality of different stations. For example, an advance station may be provided for receiving an advance roll with a film web. A compensator and/or a buffer device serve to convert a continuous conveyance, starting at the advance station, into a clocked conveyance.

A bottom sealing station, which seals the bottom seam, may be reached via several deflecting rolls. Preferably a cutting station is also provided at this bottom sealing station, which simultaneously cuts the film web into individual bag sections of a certain length. By a further conveyance via claws preferably a filling station is provided, which fills in the bulk goods via a fennel into the individual bag sections, which have already been sealed towards the bottom by a bottom seam. Also via claws, a further transportation occurs to a head sealing station, which closes the bags towards the top by another sealing seam. For the individual sealing seams preferably cooling stations are provided in order to allow an active cooling for the bottom seam as well as the head seam.

In a bag filling plant according to the invention it may be advantageous for the ejection opening to be arranged such that a bag section of the film web, which at least partially comprises the overlapping section, can be ejected from the hag filling plant. This may be understood as a simple opening or also a closed or sealable opening. For example, flaps are possible, which upon the detection of the overlapping section and after the cutting process, allow the removal by conveyance due to gravity, thus a simple dropping through the ejection opening. The individual bag sections are preferably cut off after the sealing of a bottom seam, so that the advance device simultaneously serves as the detection device. This way, an ejection can already occur in the sealing station and/or the cutting station. The further conveyance to a subsequent station and an appropriate correlation to another, offset ejection opening are also possible within the scope of the present invention.

Another objective of the present invention is a method for the detection of an overlapping section of a film web between an end of the film web of a web in use and a start of a film web of a subsequent film, particularly via a detection device according to the invention, comprising the following steps:

Sealing a bottom seam of a bag section of a film web,

Conveying a film web by the length of a bag section,

Monitoring the film web during the conveyance for an overlapping section using the detection device, Cutting the conveyed bag section, Ejecting the cut-off bag section, when an overlapping section has been detected.

In particular, here a detection device is used according to the invention, so that the same advantages can be achieved as described in detail with reference to the detection device according to the invention. The sealing of a bottom seam shall preferably be understood as the section of the hag which later will form the bottom of the bag. In particular, the ejection occurs during the travel towards another station or at another station. This way, the clock time is increased even further. The cutting and sealing of the bottom seam may preferably be performed in the very same station, essentially jointly in a simultaneous or essentially simultaneous step.

In a method according to the invention it is advantageous when prior to ejecting the bag section which was cut off, after an overlapping section has been detected, a conveyance of the hag section occurs to another station. It has already been discussed that this way the clock can be accelerated. The faster clock time allows higher production speeds for the operation of the bag filling plant. The forwarding occurs preferably via claws, which allow the movement from one station to another. In particular, the ejection occurs automated at full speed so that for exchanging the rolls after the manual adhesion of the film in use to the subsequent film no additional manual activity is required.

Further it is advantageous when in a method according to the invention a claw of the additional station moves in a closed state to the bag section which was cut, in order to support the ejection. While in the normal operation the claw of the additional station moves openly towards the bag section in order to grasp it, this preferably occurs in the closed state when an overlapping section has been detected. This way, the bag section with the overlapping section is not only gasped not grasped but furthermore it is also pushed aside by the closed claw, in order to quasi allow stripping it off and thus a further improved and secure ejection of this bag section is possible.

BRIEF DESCRIPTION OF THE DRAWINGS

Additional advantages, features, and details of the invention are discernible from the following description, in which exemplary embodiments of the invention are described in greater detail with reference to the drawings. Here, the features mentioned in the claims and the description may be essential for the invention individually or in an arbitrary combination with each other. It shows schematically:

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
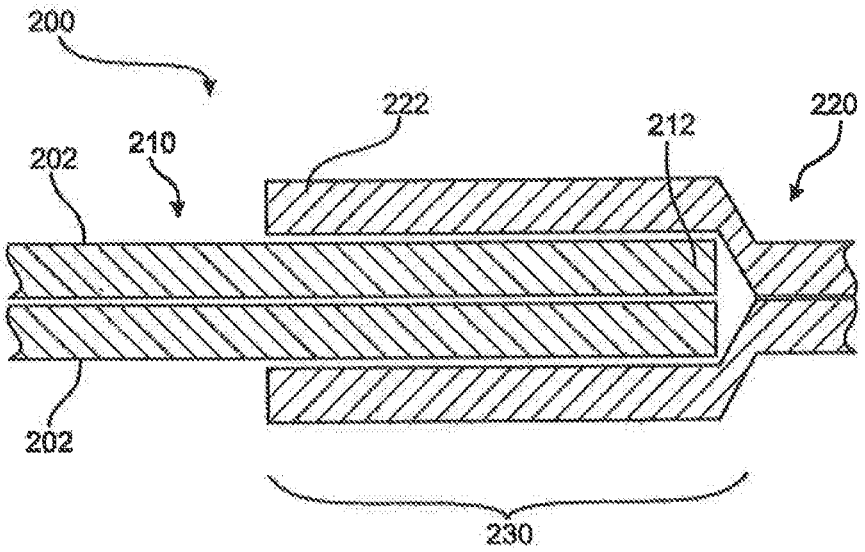
FIG. 1 a schematic cross-section through an overlapping section.

FIG. 1 shows schematically how commonly an overlap section 230 of a film web 200 is structured. Here, towards the left a film in use 210 is discernible, which comprises two side areas 202. The end of the film web 212 of the film in use 210 is already arranged inside a subsequent film 220. In other words, the end of the film web 212 of the film in use 210 overlaps the start of the film web 222 of the subsequent film 220. This overlapping forms the overlap section 230 with a considerably enlarged, namely here doubled thickness of the film web 200.

Figure 2:
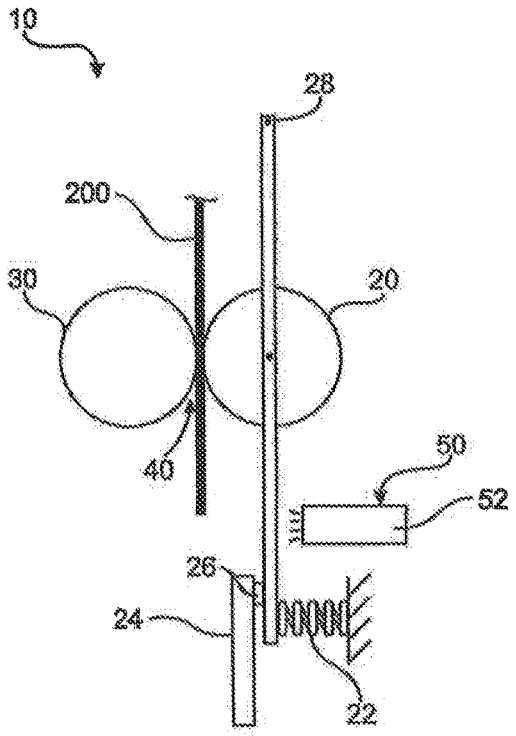
FIG. 2 a first embodiment of a detection device according to the invention.
Figure 3:
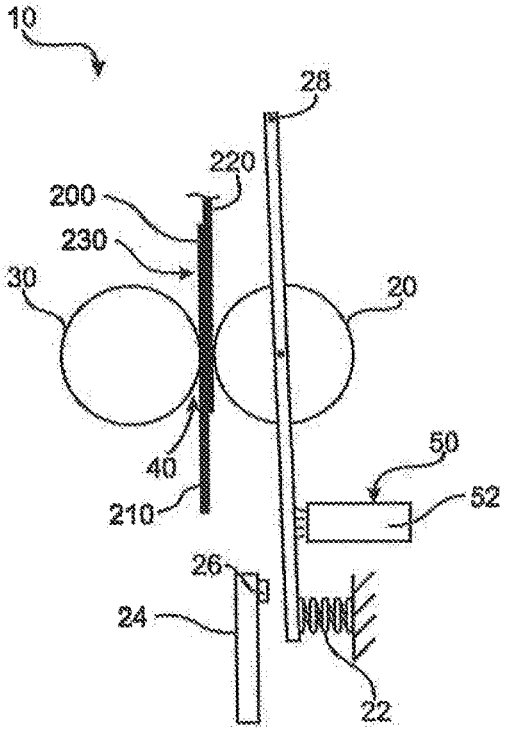
FIG. 3 the embodiment of FIG. 2 during the detection of an overlapping section, FIG. 4 an embodiment of a bag filling plant according to the invention, and FIG. 5 another embodiment of a detection device according to the invention.

FIGS. 2 and 3 show a potential embodiment of a detection device 10 according to the invention. Here, two conveyer rolls 20 and 30 are arranged, which form a conveyer gap 40 between each other. The film web 200 is guided through this conveyer gap 40 from the top towards the bottom. Preferably at least one or even both conveyer rolls 20 and 30 are driven in order to transfer the advance and thus the advance force upon the film web 200.

As also discernible from FIGS. 2 and 3, the first film roll 20 comprises a pivotal bearing device 28. In other words, the first film roll 20 can be moved away from the second film roll 30 by way of a pivotal motion about the pivotal axis of the pivotal bearing device 28.

A spring device 22 is also well discernible, which is supported for example on the frame of a bag filling plant 100. It applies the spring force upon the first film roll 20, here the pivotal bearing device 28, in order to allow the resetting to a reduced conveyer gap 40. In order to ensure that the conveyer gap 40 is never completely closed and the full spring force of the spring device 22 is never transferred to the film web here a stop device 24 is provided with a stop 26.

Additionally, a sensor device 50 is provided with a sensor means 52 in the form of an inductive sensor.

During normal operation, the film web 200 passes between the two film rolls 20 and 30, as shown in FIG. 2. During the exchange of rolls an overlapping section 230 travels through the entire bag filling plant 100, as schematically shown in FIG. 1. When the overlapping section 230 of the film web 200 reaches the detection device 10, here a motion occurs as shown in FIG. 3. The previous conveyer gap 40 is now insufficient with regards to its width in order to accept the overlapping section 230. When this overlapping section 230 enters the conveyer gap 40 it pushes the first film roll 20 via the pivotal bearing device 28 outwardly towards the right according to FIG. 3. Here, the spring device 22 is compressed and the sensor device 50 detects this motion. This detection of the motion can lead to a subsequent manual or automatic ejection of the bag section 240 of the film web 200. After the overlapping section 230 has passed, the first film roll 20 can be returned by the spring device 22 into its position according to FIG. 2.

Figure 4:
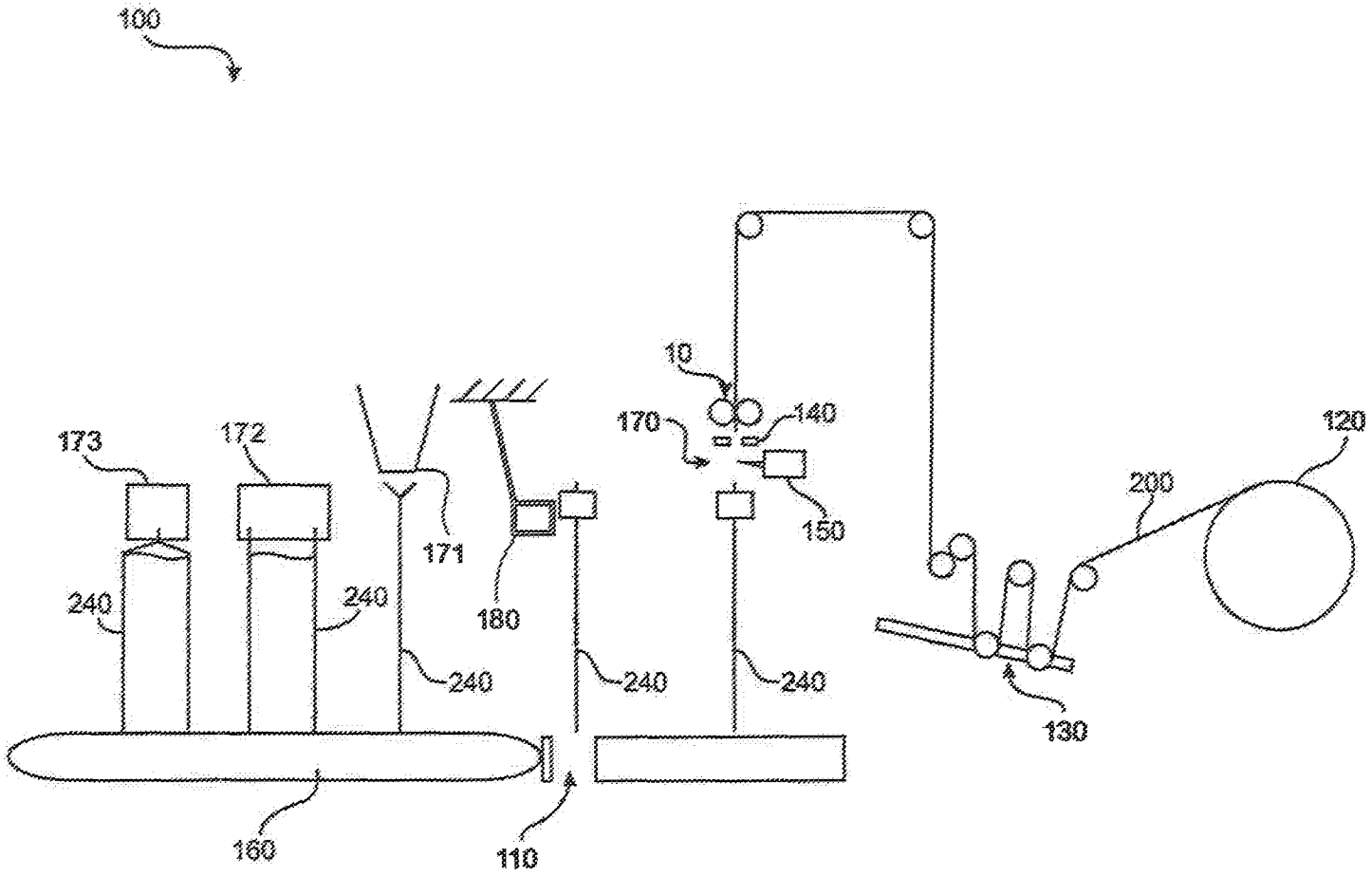

FIG. 4 shows schematically a bag filling plant 100 according to the invention. Here the film web 200 is supplied from a supply roll 120 to a buffer device 130 in the form of a compensation roll. During the continuous unrolling from the supply roll 120, then a clocked advance is possible by the buffer device 130. The detection device 10 is located at the end of the deflection rolls, simultaneously embodied as an advance drive for the film web 200. This includes a first station 170 with a sealing device 140 for sealing the bottom seam. A cutting device 150 is also provided at this first station 170, operated simultaneously with the sealing device 140.

The film web 200 is therefore pushed through by the length of a bag section 240 and simultaneously the bottom seam of the subsequent bag section 240 is formed and the lower bag section 240 is cut off. The further transportation of the bag sections 240 occurs via schematically shown claw arms 180, with an ejection of the bag section 240 through an ejection opening 110 can occur when an overlapping section 230 has been detected. Supported as subsequent stations via a conveyer belt 160 are a station 171 as a filling device, another station 122 for sealing a head seam of the filled bag section 240, as well as ultimately another station 173 for cooling the sealed head seam.

Figure 5:
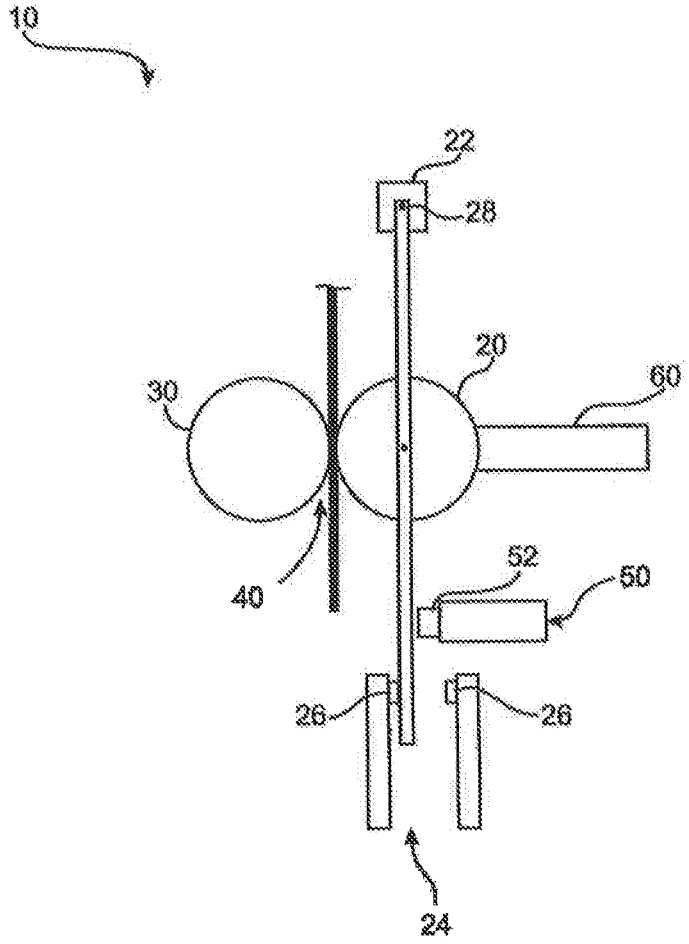

FIG. 5 shows another embodiment of a detection device according to the invention. It operates essentially in the same fashion as the embodiment of FIGS. 2 and 3. However, here it is clearly discernible that the first conveyer roll 20 comprises a drive device 60, which provides the drive for generating an advance force for the film web 200. The sensor device 50 comprises here a pressure switch as a sensor device 52. Further, it is here clearly discernible that the stop device 24 shows two stops 26 in this embodiment.

The above explanation of the embodiment describes the present invention exclusively within the scope of examples. Of course, individual features of the embodiments, to the extent technically beneficial, may be freely combined with each other without leaving the scope of the present invention.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

LIST OF REFERENCE CHARACTERS

10 Detection device
20 First film roll/conveyer roll
22 Spring device
24 Stop device
26 Stop
28 Pivotal bearing device
30 Second film roll/conveyer roll
40 Conveyer gap
50 Sensor device
52 Sensor means
60 Drive device
100 Bag filling plant
110 Ejection opening
120 Supply roll
130 Buffer device
140 Sealing device
150 Cutting device
160 Conveyer heft
170 Station

200 Film web
202 Side area
210 Film in use
212 End of the film web
220 Subsequent film
222 Start of the film web
230 Overlapping section
240 Bag section

What is claimed is:

1. A bag filling plant for the production and filling of bags with bulk goods, said bag filling plant comprising:

a detection device that detects a thickened section in a form of an overlapping section of a film web associated with an end of a first film and a start of a second film, the detection device including a first film roll and a second film roll, which contact the film web on side areas aligned opposite each other and which form a conveyer gap for the film web, with the first film roll being movably supported relative to the second film roll in order to alter the conveyer gap, and a sensor device for detecting a motion of the first film roll, with the detection device being configured as a transport device for the film web;

a sealing device that seals the film web to create a bag bottom, and cutting device that cuts the sealed film web to create a separated ban section, with the sealing device and the cutting device being located after the detection device in a transport direction of the film web;

a claw device that conveys the separated bag section to a bag filling station, the claw device being configurable to an open position and to a closed position, with the claw device first being in the open position and then in the closed position so as to grasp the separated bag section to be conveyed; and an ejection opening arranged in a transport path of the separated bag section such that a separated bag section which has been detected by the detection device to include the overlapping section is ejectable from the transport path via the ejection opening, such that, to effect the ejection of the detected overlapping section separated bag section, the claw device contacts the overlapping section separated bag section in the closed position so as to divert the overlapping section separated bag section into the ejection opening and out of the transport path.

2. The bag filling plant according to claim 1, wherein at least one of the first film roll and the second film roll includes a drive device for a rotational drive thereof and an active advance of the film web.

3. The bag filling plant according to claim 1, wherein the first film roll includes a spring device, which impinges a lever connected to the first film roll with a force in a direction that reduces the conveyer gap.

4. The bag filling plant according to claim 1, wherein the first film roll includes a stop device with at least one stop for limiting at least one of an enlargement and a reduction of the conveyer gap.

5. The bag filling plant according to claim 1, wherein the sensor device includes at least one of an inductive sensor, a capacitive sensor, a pressure switch, a photosensor, a proximity sensor, a force sensor, and an ultrasound sensor.

6. The bag filling plant according to claim 1, wherein the first film roll includes a pivotal bearing device for a pivotal support.

* * * * *